United States Patent [19]

Marais

[11] 4,223,747

[45] Sep. 23, 1980

[54] DRILLING USING REVERSE CIRCULATION

[75] Inventor: Lionel R. Marais, Paris, France

[73] Assignee: Compagnie Francaise des Petroles, Paris, France

[21] Appl. No.: 954,804

[22] Filed: Oct. 26, 1978

[30] Foreign Application Priority Data

Oct. 27, 1977 [FR] France ..... 77 32448

[51] Int. Cl.[2] ..... E21B 3/00

[52] U.S. Cl. ..... 175/65; 175/107; 175/215; 175/324

[58] Field of Search ..... 179/65, 7, 107, 215, 179/320, 324

[56] References Cited

U.S. PATENT DOCUMENTS

| | | | |
|---|---|---|---|
| 1,378,056 | 5/1921 | Reed et al. | 175/324 X |
| 2,765,146 | 10/1956 | Williams, Jr. | 175/324 X |
| 2,849,214 | 8/1958 | Hall | 175/324 |
| 2,946,565 | 7/1960 | Williams | 175/65 X |
| 2,984,308 | 5/1961 | Bauer et al. | 175/7 |
| 2,991,837 | 7/1961 | Postlewaite | 175/107 |
| 3,015,360 | 1/1962 | Stratton | 175/7 X |
| 3,153,290 | 10/1964 | Saito | 175/65 X |
| 3,259,198 | 7/1966 | Montgomery et al. | 175/215 X |
| 3,362,488 | 1/1968 | Ionnesyan et al. | 175/107 X |
| 4,103,749 | 8/1978 | Erickson | 175/107 X |

FOREIGN PATENT DOCUMENTS

| | | | |
|---|---|---|---|
| 767901 | 12/1971 | France | 175/320 |

*Primary Examiner*—Stephen J. Novosad
*Assistant Examiner*—George A. Suchfield
*Attorney, Agent, or Firm*—Sughrue, Rothwell, Mion, Zinn and Macpeak

[57] ABSTRACT

In drilling a hole using reverse circulation and the Venturi effect, drilling fluid is caused to flow through the annulus between the set of drill pipes and the hole and to rise under reduced pressure in the interior of the drill pipes to a level at which it is ejected outside the drill pipes, using a fluid diverting device connected in the set of drill pipes and which includes a Venturi tube, the device causing ejection of the fluid from the interior of the pipes, drilling fluid being pumped from the surface in the interior of the drill pipes to the device in which it is diverted into the Venturi tube to cause upward flow of fluid from the drill tool.

7 Claims, 3 Drawing Figures

DRILLING USING REVERSE CIRCULATION

The invention relates to a drilling process using reverse circulation, with a pressure-reducing action and reversal of the circulation in the set of drill pipes, and also to the means for carrying out this process.

It is known that the speed of advance of drilling tools, and also their wear, depend not only on the ground which is cut, but also on the pressure difference existing between the pressure of the drilling sludge and the pressure of the fluids contained in the ground which is being cut.

It has therefore already been proposed to create, at the level of the drilling tool, a pressure reduction which enables sludge, having irrigated the working face, to rise up to a pressure-reducing chamber, which is created by means of the Venturi effect and provided in the tool, where it is mixed with the sludge descending through the set of drill pipes in the tool before being re-directed towards the circuit for irrigating the working face, part of this drilling sludge rising up into the annulus between the drill hole and the set of drill pipes.

Although this improvement has advantages, it does not make it possible to benefit from as effective a protection of the ground cut by the drill as that achieved by means of the reverse circulation process, because the fraction of the sludge which comes from the tool and is directed towards the annulus is already charged with debris.

According to one aspect of the invention there is provided a drilling process which simultaneously ensures good protection of the drilled ground by means of downward circulation of a fluid or clean sludge over the whole length of the exposed drill hole, and the rapid advance of the tool, whilst decreasing its wear by lifting the sludge, under reduced pressure, through the set of drill pipes to the level of the tubing, the sludge charge with debris being carried to this level by the Venturi effect and then supplied to the annulus between the set of drill pipes and the tubing, the clean sludge, pumped from the surface into the set of drill pipes, being directed, below this level, into the lower part of the annulus towards the drill hole.

If reverse circulation is available over the whole extent of the drill hole, not only does the drilled ground receive an effective protection, but the sludge descending in the annulus can irrigate the working face without being contaminated by the presence of debris. In addition, the sludge rising through the set of drill pipes can be sucked up by the Venturi effect and driven into the annulus between the tubing and the set of drill pipes, to a sufficiently high level to be able to escape the pressure losses in the non-tubed regions. It is possible to simultaneously reduce the pressure difference between the pressure of the seams at the drilling level and the pressure exerted by the sludge, whilst easily raising the debris into the upper part of the annulus between the set of drill pipes and the casing.

According to another aspect of the invention there is provided apparatus for use in carrying out the above process comprising, a device for diverting the drilling fluid for connection in the set of drill pipes at the desired height, the device comprising a body defining at least one upper inlet channel for connecting the interior of the upper part of the set of drill pipes to a lower orifice opening out onto the lower part of the annulus, and at least one lower inlet channel connecting the interior of the lower set of drill pipes to a pressure-reducing chamber which communicates with at least one upper outlet channel opening out onto the upper annulus between the tubing and the set of drill pipes, said upper inlet channel additionally opening out into said chamber through a Venturi tube.

It therefore suffices to inject the drilling fluid or sludge, at the surface, into the set of drill pipes in order, on the one hand, to carry part of it into the lower part of the annulus towards the drill hole and the drill tool, and, on the other hand, to feed the Venturi tube so as to create a pressure reduction which is used to raise the sludge which is charged with the debris from the tool and directed into the set of drill pipes. The sludge is then ejected through the device into the upper part of the annulus. Where the cross-section of the annulus between the drill hole and the set of drill pipes is much greater than the cross-section of the set of drill pipes, the debris is raised into the set of drill pipes at a much greater speed than that of the sludge reaching the tool, with the result that any debris is prevented from falling back at this level. In addition, it suffices to place the diverting and pressure-reducing device at a sufficient depth, for example of the order of 1,000 meters, to create a hydrostatic pressure of 100 bars therein, which makes it possible to generate a pressure reduction of the order of 30 bars in the Venturi tube. The fact that sludge is brought through the diverting channel to the Venturi tube increases the flow-rate of the sludge circulating in the upper part of the annulus between the set of drill pipes and the tubing thus preventing any debris from falling back in this region.

The low flow-rate obtained along the walls of the drill hole enables the sludge, coming directly from the surface through the device, to fully perform its funtion of equilibrating the fluids contained in the ground, without erosion of the wall of the drill hole and with the formation of a minimum amount of cake, whilst benefiting from a high flow-rate in the upper part of the annulus between the set of drill pipes and the tubing.

In addition, the Venturi effect of the device ensures efficient mixing of the debris, which has risen through the set of drill pipes, with the sludge coming from the upper part of the set of drill pipes. This same mixing effect makes it possible to eliminate the formation of large bubbles of gas rising into the tool, these bubbles diving up in the injected sludge.

In the case of under-water drilling, the sludge may rise to the surface through the annulus between the set of drill pipes and the riser-pipe. In the case of a simple lead-in hole without a riser-pipe, the debris can simply be discharged into the sea. Thus, the diverting device no longer has to possess a lower outlet passage towards the drill hole, the water injected into the set of drill pipes serving only to create a pressure reduction for raising the debris, mixed with the sea-water, into the lower part of the set of drill pipes and discharging it into the sea.

Figure 1:
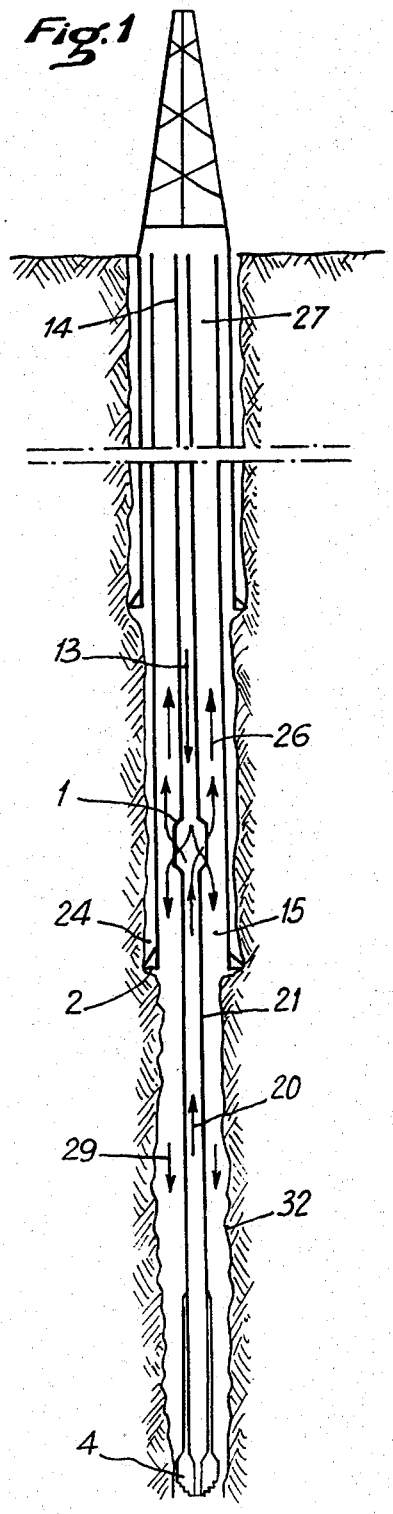
FIG. 1 is a simplified view of a well with an embodiment of apparatus for carrying out the method according to the invention.
Figure 2:
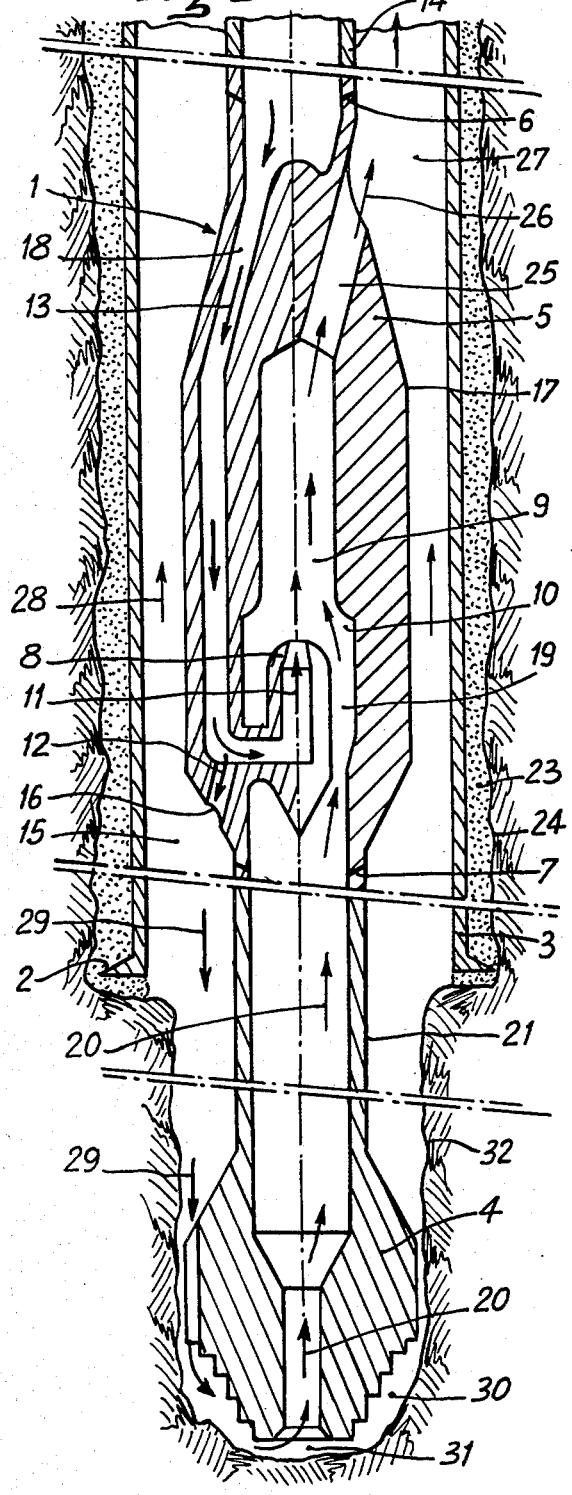
FIG. 2 is a simplified sectional view showing a diverting device and a drilling tool used in FIG. 1.

The diverting and pressure-reducing device 1 shown in FIG. 2 is represented schematically in FIG. 1. Arrows 13, 20, 29, and 26 respectively indicate the direction of circulation of the fluids inside a set of upper drill pipes 14 a set of lower drill pipes 21, a lower annulus 15 between the walls 32 of the drill hole and the set of drill pipes 21, and an upper annulus 27 between the set of drill pipes 14 and tubing 3. The drill head and also the pumping installation and other equipment which are not important to an understanding of the invention have not been shown.

The diverting device 1 is inserted between the upper and lower sets of drill pipes 14 and 21 at a level which is such that, when the tool 4 is in the drilling position, the device 1 is located above the lower end 2 of the inner tubing 3 (FIG. 2), the lower part of which is cemented at 23 in the drill hole 24. The device 1 is formed by a body 5 which is screwed to the set of drill pipes 14 by means of a thread 6 and to the set of drill pipes 21 by means of a thread 7. The outer surface 17 of the body 5 is sufficiently smooth not to damage the tubing during the rotation of the set of pipes, which causes the rotation of the tool 4.

The body 5 possesses one or more upper inlet channels 18, communicating with the interior of the upper set of drill pipes 14, and one or more lower inlet channels 19 communicating with the interior of the lower set of drill pipes 21. The upper inlet channel or channels 18 communicate directly with a lower outlet nozzle or nozzles 16, the lower inlet channels 19 communicating with the upper outlet channel or channels 25 via a chamber 9, the channel or channels 19 opening into chamber 9 at 10 which is at the level of a nozzle 8. The nozzle 8 is connected to the lower end of the upper inlet channel or channels 18 by means of one or more off-takes. In the embodiment shown, the nozzles 16 are located immediately below the change of direction of channel or channels 18, permitting the fluid flowing in the direction of arrow 13 to rise in the direction of arrow 11 into the nozzle 8.

When drilling sludge is injected, at the surface, into the set of dril pipes 14, it passes through the channels 18 where it divides up into a part which is directed towards the nozzle 8, and a part which flows through nozzles 16 into the annulus between the drill hole 32 and the set of drill pipes 21, and then into the region 30 onto the tool 4. The sludge charged with the drilling debris rises at 31 into the tool 4. The rise of the sludge into the set of drill pipes 21 has been shown by arrow 20. Its speed is then accelerated in the channel or channels 19 leading to the chamber 9 through the or each access 10. The nozzle 8 and the chamber 9 make it possible to increase the speed of the part of the sludge flowing through the nozzle 8 from the surface through the channels 18, and to create a pressure reduction which carries along the part of the sludge charged with debris from the tool. The mixture of these sludges is thus ejected through the channel or channels 25 opening out into the upper annulus 27.

In this circulation, the pressure at 15, at the outlet of the or each nozzle 16, is slightly greater than the hydrostatic pressure and the pressure prevailing in that region 27 of the upper annulus which is near the outlet channel 25. As a result, there is a slight flow of sludge in the direction of arrow 28 which is sufficient to prevent the debris from falling back and to cool the device 1 in the case of friction on the tubing 3. The pressure at 15 is also sufficient to overcome the pressure losses caused in th annulus between the drill pipes 21 and the tubing 3 and then between the drill pipes 21 and the drilled hole 32.

In the case where it is necessary to place the device 1 below the lower level 2 of the last tubing, 3, it is still possible to use the device without damaging the drill hole, by restricting the rate of the feed issuing from the nozzle 16.

It will be appreciated that the device can be used equally on a land well as an under-water well, the sludge then being pumped from the platform or the drilling vessel.

If a lead-in hole is produced and there is no risk of pollution, it is possible to use the device at a level between the sea bed and the surface, without positioning any tubing and without using a riser-pipe. Under these conditions, the nozzles 16 can be omitted, the water pumped from the surface into the set of upper drill pipes having the sole purpose of causing the sludge, consisting of the drilling debris, to rise up to the channel 25 where it is ejected directly into the sea-water, the device 1 being above the sea bed.

Figure 3:
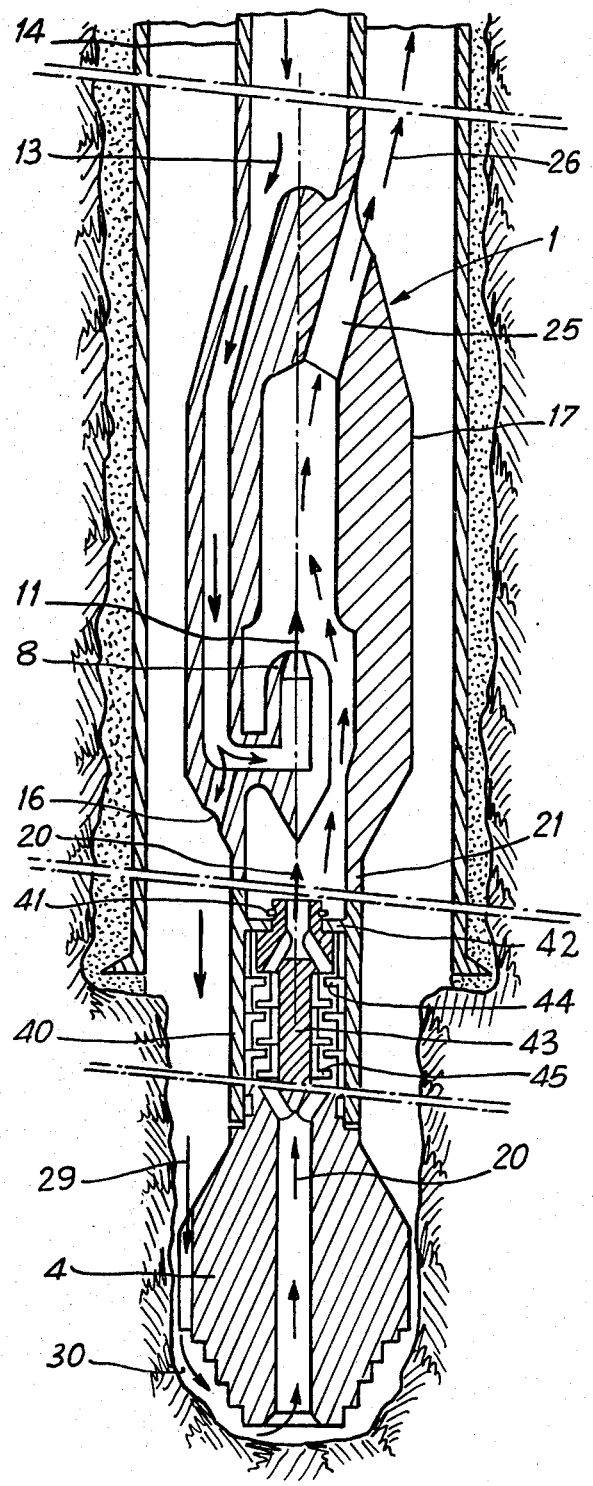
FIG. 3 is a simplified sectional view showing a modification of the device of FIG. 2.

In the modification shown diagramatically in FIG. 3, in which the same reference numerals have been retained for the same elements, a turbine 40 for driving the tool is inserted between the device 1 and the tool 4. Stops 41 are provided for holding back the suspended turbine and a bearing 42 reacts to the thrust to which the axle of the rotor 43 is subjected. The vanes of the stator and of the rotor have been shown respectively by 44 and 45. Since the axle of the rotor 43 is integral or fast with the tool 4 and the stator is integral or fast with the set of drill pipes 21, advantage is gained from the lower reverse circulation represented schematically by the arrow 29, on the one hand, for cooling the tool 4 and, on the other hand, during the rise of the fluid in the direction of arrow 20, for rotating the vanes 43, the fluid 20, which is charged with debris and has passed through the turbine, rising into the set of drill pipes 21 through the same circuits as those which have already been described with reference to FIG. 2.

What is claimed is:

1. A method of earth boring, comprising the steps of:

(a) pumping clean drilling fluid down through the hollow interior of a set of upper pipes in a string to a level above the lowest one of a plurality of casing members lining a bore hole, (b) unidirectionally ejecting a first portion of the clean drilling fluid at said level into a first annular space below said level between an unlined, lower portion of said bore hole and a set of lower pipes in said string connected to a drilling tool at the bottom of the string, (c) reversing the direction of a second portion of the clean drilling fluid at said level, (d) ejecting said second portion of the clean drilling fluid through upwardly directed Venturi nozzle means in communication with the hollow interior of said set of lower pipes and drilling tool, whereby a reduced pressure is established at the outlet of said nozzle means which draws drilling fluid contaminated with earth cuttings at said drilling tool up through the interior of said set of lower pipes, and (e) unidirectionally ejecting said contaminated drilling fluid and said second portion of the clean drilling fluid into a second annular space between said set of upper pipes and said casing members.

2. A method as claimed in claim 1, wherein the pressure of said clean drilling fluid in the first annular space is slightly greater than its hydrostatic pressure and the pressure of the mixture of said second portion of the clean drilling fluid and said contaminated drilling fluid after its ejection into the second annular space.

3. A method as claimed in claim 1, wherein said borehole is under water and the contaminated drilling fluid is discharged from said set of lower pipes directly into the water at a level between the seabed and the surface of the water.

4. A method as claimed in claim 1, wherein a turbine is used to drive for driving the drilling tool, and the contaminated drilling fluid drives the rotor of said turbine.

5. An apparatus for earth boring, comprising a body member adapted to be coupled into a drill string at a level above the lowest one of a plurality of casing members lining a borehole, and defining:

(a) an upper inlet channel for clean drilling fluid communicating with the hollow interior of a set of upper pipes in said drill string, (b) a lower inlet channel for contaminated drilling fluid communicating with the hollow interior of a set of lower pipes in said string connected to a drilling tool at the bottom of the string, (c) a lower outlet nozzle for clean drilling fluid communicating with said upper inlet channel and discharging downwardly into a first annular space below said level between an unlined, lower portion of said borehole and said set of lower pipes, (d) a pressure reducing chamber within the body member communicating at its lower end with said lower inlet channel, (e) upwardly directed Venturi nozzle means disposed within said chamber and having an inlet passage in communication with said upper inlet channel, and (f) an upper outlet nozzle for a mixture of both clean and contaminated drilling fluid communicating with said chamber and discharging upwardly into a second annular space between said set of upper pipes and said casing members.

6. An apparatus as claimed in claim 5, wherein the upper inlet channel and the lower inlet channel respectively terminate at a coupling which is screw-threaded for receiving the upper and lower pipes.

7. An apparatus as claimed in either claim 5 or claim 6, wherein the lower inlet channel is connected to an upper outlet channel of a turbine for controlling the rotation of the drilling tool, a channel for raising the drilling fluid from the tool being connected to an inlet of said turbine which receives the upward circulation of the drilling fluid, and the drilling fluid driving vanes of a rotor of said turbine in order to rise up to said lower inlet channel of said body member.

* * * * *